US005286403A

United States Patent [19]

O'Dwyer et al.

[11] Patent Number: 5,286,403

[45] Date of Patent: Feb. 15, 1994

[54] CONCENTRATED CLEANING COMPOSITIONS

[76] Inventors: Michael O'Dwyer, 775 Kingston Dr., Edgewood, Ky. 41017; Mary K. Haber, 6984 Grace Ave., Cincinnati, Ohio 45227; Eddy Stephens, 4530 Paddock Rd., Cincinnati, Ohio 45229

[21] Appl. No.: 20,865

[22] Filed: Feb. 19, 1993

Related U.S. Application Data

[63] Continuation of Ser. No. 694,798, May 2, 1991, abandoned, which is a continuation-in-part of Ser. No. 414,762, Sep. 29, 1989, abandoned.

[51] Int. Cl.[5] ..... C11D 1/831

[52] U.S. Cl. ..... 252/136; 252/142; 252/173

[58] Field of Search ..... 252/136, 142, 173, 174.21, 252/558

[56] References Cited

U.S. PATENT DOCUMENTS

| | | | |
|---|---|---|---|
| 3,214,380 | 10/1965 | Gangwisch | 252/100 |
| 4,124,523 | 11/1978 | Johnson | 252/145 |
| 4,608,086 | 8/1986 | Dodge | 252/142 |
| 4,749,508 | 6/1988 | Cockrell, Jr. et al. | 252/136 |
| 4,759,867 | 7/1988 | Choy | 252/143 |

FOREIGN PATENT DOCUMENTS

| | | |
|---|---|---|
| 957383 | 10/1973 | Italy . |
| 511335 | 4/1976 | U.S.S.R. . |

*Primary Examiner*—Gary P. Straub
*Assistant Examiner*—Stuart L. Hendrickson
*Attorney, Agent, or Firm*—Eliot S. Gerber

[57] ABSTRACT

Phase stable, aqueous cleaning concentrates containing an inorganic acid together with an organic carboxylic acid which has a pKa value of from 1.0 to 5 and a mixture of nonionic and anionic surfactants, are described.

9 Claims, No Drawings

CONCENTRATED CLEANING COMPOSITIONS

RELATED APPLICATION

This application is a continuation of U.S. application Ser. No. 07/694,798, filed May 2, 1991, which is a continuation-in-part partly based on application Ser. No. 07/414,762, filed Sep. 29, 1989, both now abandoned.

FIELD OF THE INVENTION

This invention concerns acidic cleaning compositions which are particularly useful in cleaning tile floors. More specifically, the invention concerns concentrated compositions, i.e., compositions to which water or other solvent is added prior to use.

BACKGROUND OF THE INVENTION

Cleaning compositions containing a strong mineral acid such as hydrochloric acid are known.

U.S. Pat. No. 3,793,221 to Otrhalek describes a concentrate composition comprising 15–40% of aqueous HCl; 1–6% of an organic acid selected from oxalic, tartaric and citric acids; 7–23% nonionic surfactant; and 76–24% water. The sum of the amounts of surfactant is from 10–30% by weight of the composition, and the nonionic surfactant is about 75–90% by weight of the total surfactants. For use, the concentrate of this patent is diluted with from 1–5 parts water.

U.S. Pat. No. 4,032,466 also to Otrhalek discloses acid cleaning concentrates similar to the compositions of the '221 patent but also containing 1–12% of a flocculating agent. The water content varies from 75–12%.

U.S. Pat. No. 4,749,508 to Cockrell, Jr. et al discloses an acidic floor cleanser in ready to use concentrate form comprising 1–6% of an acid having a pKa value greater than 2.8 at 25° C.; typically, citric, tartaric, malic, acetic, glycolic or gluconic acids. Additionally, the compositions contain 0.1–15% of an acid such as sulfuric, phosphoric, hydrochloric, or nitric acid with a pKa value of less than 2.5 at 25° C. together with sufficient buffering salt to provide a composition having a pH of 1–6. The composition may also contain a surfactant, fumed silica or other selected ingredients.

Schmidt et al in U.S. Pat. No. 3,443,492 discloses a process for cleaning evaporation tubes with a mixture of an organic acid and a mineral acid. The former is utilized in an amount of from 20–40% by weight of the total acid in the composition.

U.S. Pat. No. 3,218,260 to Lewandowski discloses a cleaning composition comprising an acid in combination with an anionic surfactant which is an ethoxylated hydrophobic base, the agent containing at least 10 moles of ethylene oxide per mole of the base. The compositions of the patent are said to be characterized by good clarity in water.

U.S. Pat. No. 4,409,525 to Dodge discloses an etchant comprising a strong acid, a weak organic acid, and a water miscible solvent. A characteristic of the compositions of this invention is that they contain a minimum amount of water, i.e. less than 30% by weight.

Martucci, in U.S. Pat. No. 4,675,120 discloses compositions containing controlled amounts of hydrogen ion, the availability of which is maintained by combining strong and weak acid pairs.

Aqueous glass cleaning compositions are disclosed in U.S. Pat. No. 4,477,364 to have a pH of less than 1 and contain 1–13%, HF together with 85–99% mineral hydrocarboxylic or dicarboxylic acid.

Commercial, floor cleaning products are also known. One such composition is SURE TRAC sold by the Drackett Company. The composition is an aqueous mixture containing an anionic and a nonionic surfactant together with hydrochloric and glycolic acids, and is typically used after dilution with water.

Compositions such as SURE TRAC are excellent floor degreasers and are especially useful for quarry tile and concrete floors often provided in large food dispensing operations such as fast food restaurants. Although the ready-to-use aspect of such products is advantageous, they suffer the disadvantage that they contain large amounts of water. The high proportions of water adds to the cost of shipping and warehousing. Concentrates, on the other hand, although less expensive than ready-to-use compositions are often times not satisfactory because of a tendency to phase out on storage or when subjected to temperature stress. Moreover, the manufacture and bulk storage of the concentrate and before its final packaging for customer use is difficult in view of the tendency of the concentrate to separate on standing. In many instances once separation has occurred, it is difficult if not impossible to reconstitute and reobtain the properties of the original composition, especially viscosity.

Accordingly, it is an object of this invention to provide floor cleaning concentrates which do not suffer the disadvantages of the high water content compositions and have good storage stability, even under temperature stress.

SUMMARY OF THE INVENTION

The cleaning compositions of this invention are concentrated aqueous compositions which will not separate into phases on storage even when subjected to temperature abuse. They comprise aqueous concentrates of water, a mineral acid, an organic acid and a mixture containing at least one anionic and one nonionic surfactant. They may be employed directly or in admixture with additional water.

DETAILED DESCRIPTION AND PREFERRED EMBODIMENTS

The concentrated cleaning compositions of this invention comprise aqueous compositions containing a mineral acid such as hydrochloric or phosphoric acid and a carboxylic acid together with one or more surfactants selected from the group consisting of anionic and nonionic surfactants. The compositions are particularly characterized by their low water content which is preferably less than 66.0% by weight of the composition. Typical mixtures will contain from 43.4 to 66.0% water. Presently preferred mixtures contain from 50 to 60% water. Unless otherwise noted, all concentrations, including HCl, are on an anhydrous weight percent active basis.

The presently preferred mineral acid is hydrochloric acid because it is easy to use and readily available at a reasonable cost.

Carboxylic acids, especially hydroxy carboxylic acids may be employed. The presently preferred organic acid is glycolic acid because it is easy to work with and readily compatible with the other components of the composition.

Typically useful carboxylic acids are those acids with $pK_a$ values of above about 1.0 to 5, preferably from 2.5 to 4. These include, for example, malic, glycolic, hydroxybenzoic, acetic, tartaric, gamma hydorxylbutyric, citric and gluconic acids.

Anionic and nonionic surfactants that are compatible with the highly acidic environment present in the compositions of the invention are suitable and are present, after dilution of the concentrate with water in an effective cleaning amount. In the concentrate composition of the present invention, the surfactant is present in an amount of from about 12.2 to about 39.8% by weight, preferably from about 24 to about 36%. A blend of an anionic and nonionic is particularly suitable, especially in a weight ratio of nonionic to anionic of from about 1:2 to 2:1, preferably from about 0.89:1 to about 1.3:1, most preferably from about 1.0:1 to about 1.1:1.

Broadly, the anionic surfactants are water-soluble alkyl or alkylaryl compounds, the alkyl having from about 8 to about 22 carbons, including a sulfate or sulfonate substituent group that has been base-neutralized, typically to provide an alkali metal, e.g., sodium or potassium, or an ammonium cation, including, for example: (1) alkyl and alkylaryl sulfates and sulfonates having preferably 8 to 18 carbons in the alkyl group, which may be straight or branched chain, e.g., sodium lauryl sulfate and sodium dodecylbenzene sulfonate; (2) alpha-olefin aryl sulfonates preferably having from about 10 to 18 carbons in the olefin, e.g., sodium $C_{14-16}$ olefin sulfonate, which is a mixture of long-chain sulfonate salts prepared by sulfonation of $C_{14-16}$ alpha-olefins and chiefly comprising sodium alkene sulfonates and sodium hydroxyalkane sulfonates; (3) sulfated and sulfonated monoglycerides, especially those derived from coconut oil fatty acids; (4) sulfate esters of ethoxylated fatty alchols having 1-10 mols ethylene oxide, e.g., sodium polyoxyethlene (7 mol EO) lauryl ether sulfate, and of ethoxylated alkyl phenols having 10 mols ethylene oxide and 8 to 12 carbons in the alkyl, e.g., ammonium poloxyethylene (4 mol EO) nonyl phenol ether sulfate; (5) base-neutralized esters of fatty acids and isethionic acid, e.g., sodium lauroyl isethionate; (6) fatty acid amides of a methyl tauride, e.g., sodium methyl cocoyl taurate; (7) -acetoxy- or acetamido-alkane sulfonates, and (8) sarcosinates having from 8 to 22 carbons, e.g., sodium lauroyl sarcosinate.

The nonionics include (1) fatty alcohol alkoxylates, especially ethoxylates, wherein the alkyl group has from 8 to 22, preferably 12 to 18, carbons, and typically 6 to 15 mol alkoxide per molecule, e.g., coconut alcohol condensed with about nine mols ethylene oxide; (2) fatty acid alkoxylates having from about 6 to 12 carbons, preferably octyl or nonyl, in the alkyl, and having about 5 to 25, preferably 5 to 15 mols alkylene oxide per molecule, e.g., nonyl phenol ethoxylated with about 9.5 mols ethylene oxide (Igepal Co-630); (4) condensates of ethylene oxide with a hydorphobic base formed by condensation of propylene oxide with propylene glycol, e.g., nonionic surfactants of the Pluronice series manufactured by BASF Wyandotte, (5) condensates of ethylene oxide with an amine or amide; (6) fatty amine oxides, e.g., stearyl dimethyl amine oxide, and (7) alkloamides.

As used in the two preceding paragraphs, water solubility shall mean that the amount of surfactant or blend of surfactants used are completely miscible in the compositions of the present invention, at the water concentration present therein.

Preferred anionics are the alkyl and alkylaryl sulfates and the alpha-olefin aryl sulfonates, which may be included in the form of the free acid while preferred nonionics are the fatty alcohol ethoxylates having 6 to 15 mols of ethylene oxide per molecule.

A number of specific anionic surfactants are available and can be employed in the practice of this invention. The presently preferred member of the class is dodecylbenzene sulfonic acid which is available as CALSOFT LAS-99 from Pilot Chemical. Other useful anionic surfactants include sodium alpha olefin sulfonates and sodium lauryl sulfate.

The presently preferred nonionic surfactant is nonylphenoxypoly (ethyleneoxy) ethanol having an average of 9 mols of ethylene oxide per molecule. It is sold by G.A.F. Corporation, Chemical Product Division as IGEPAL (CO-630). Other nonionic surfactants useful in the invention include TRITON X-100 which is octylphenoxypolyethoxy ethanol containing 9 mols of ethylene oxide per molecule, sold by Union Carbide, and TERGITOL 15-S-7, 15-S-9 or 15-S-12. These are polyethylene glycol ethers of a mixture of synthetic $C_{11}$-$C_{15}$ fatty alcohols containing, respectively 7, 9 and 12 mols of ethylene oxides. These products are also available from Union Carbide.

The principal and most characteristic property of the compositions of this invention is that they do not tend to phase out on storage even when subjected to temperature abuse such as an alternate freeze-thaw cycle. Preferably, the products of this invention do not separate into two or more phases when stored for three months at room temperature and one month at 125° F./51.7° C. In addition, the product should preferably pass through at least one freeze-thaw cycle without separation. When measured by these criteria, the products of this invention are stable.

Dilute aqueous compositions such as SURE TRAC containing relatively large amounts of water are phase stable and do not separate on standing. The stability of the products is commercially acceptable even at elevated and reduced temperatures.

It would be expected that this phase stability would be lost as the relative amount of water in the compositions is decreased and the relative amounts of the active components increased. This, indeed, is what is observed with most compositions of this nature. Surprisingly, however, the concentrated compositions of this invention have been discovered to manifest a phase stable concentration zone between phase unstable zones which are either more or less concentrated in non-aqueous components. Stability is defined as a composition that resists separation into two or more phases for a period of not less than about one month at 100° F.

This unexpected phenomenon is illustrated in the following Table 1.

TABLE 1

| Component | % By Wt. Blend 1 | % By Wt. Blend 2 | % By Wt. Blend 3 |
|---|---|---|---|
| Dodecylbenzene sulfonic acid | 12 | 16 | 20 |
| Nonyl phenol ethoxylate- 9 mols ethylene oxide | 12 | 16 | 20 |
| Glycolic acid[1] | 8.4 | 11.9 | 14 |
| Hydrochloric acid[2] | 1.54 | 2.05 | 2.56 |
| Water | 66.06 | 54.05 | 43.44 |

[1]70% glycolic acid calculated as anhydrous acid
[2]20° Baume (about 32%) hydrochloric acid calculated as anhydrous acid When tested for stability by the procedures described above, it was observed that Blends 1 and 3 were unstable, whereas Blend 2 was stable. It will be noted that in Blend 1 the amounts of active components are less than in Blend 2, and that in Blend 3 the % by weight of active components is higher than in Blend 2. Blend 2 remains stable even when subjected to 125° F. for 28 days or to freeze-thaw.

In special situations where high cleaning power is required, the concentrated compositions of this invention can be employed directly, i.e. as a ready-to-use composition.

In most instances, however, the selected composition will be diluted with water prior to use or as used. For example, the composition may be mixed with water at any desired ratio, e.g. at a concentrate:water ratio of from about 1:250 to about 1:4, preferably from about 1:125 to 1:24. Alternatively, the concentrate can be mixed with water utilizing any of a variety of special spray devices such as a Gilmore sprayer which may be attached to a hose to siphon the concentrate from a closed holding vessel. The dilution rate may be selected based on the cleaning need.

The actual use of the compositions, with or without dilution, is conventional, i.e. the composition is applied to the surface to be cleaned. The surface is scoured to the extent necessary and then rinsed.

The viscosity of the concentrates of this invention is from about 50 to 200 cps, preferably from 100 to 150 cps. This high viscosity is a special advantage when the compositions are employed in the ready-to-use mode. The reason is that the viscous compositions do not tend to run so that the active components remain in contact with the surface to be cleaned.

The mineral and organic acid components of the composition of the invention assist in the cleansing operation by functioning as mild etchants. By so doing, they increase the surface area of the surface to be cleaned, e.g. the tiles, thereby increasing their non-skid properties. Glycolic acid also has some chelating ability which contributes to the cleaning activity.

The amount of inorganic acid in the compositions is from about 1.55 to 2.50%, preferably 1.6 to 2.0%, calculated as active acid on an anhydrous basis. The amount of organic carboxylic acid is from about 9 to 13% on the same basis.

The amount of water is from about 43.4 to 66.0%, preferably 50 to 60%.

The compositions of this invention are preferably prepared by forming an aqueous solution of the surfactant and thereafter adding in sequence the selected organic acid followed by the inorganic acid, e.g., glycolic acid followed by hydrochloric acid. This order of addition reduces the likelihood of phasing during manufacture. The acids should be added with thorough mixing to form homogeneous compositions.

In this disclosure and in the claims, the amounts of all components are calculated as weight percent based on the total weight of the composition.

The following examples are given by way of illustration only and are not to be considered limitations of this invention, many apparent variations of which are possible without departing from the spirit or scope thereof.

Examples 1 to 24

The following cleaning concentrates are illustrative of the compositions of the present invention. In the examples, the glycolic acid is 70% and the hydrochloric acid is a 20° Baume HCl composition.

| Example | Water | IGEPAL CO-630 | GLYCOLIC Acid, 70% | CALSOFT HYDROCHLORIC LAS-99 | CALSOFT HYDROCHLORIC ACID 32% |
|---|---|---|---|---|---|
| 1 | 48.1 | 16.0 | 16.0 | 14.0 | 5.9 |
| 2 | 50.6 | 16.0 | 14.0 | 14.0 | 5.4 |
| 3 | 52.1 | 16.0 | 14.0 | 12.0 | 5.9 |
| 4 | 43.6 | 16.0 | 18.0 | 16.0 | 6.4 |
| 5 | 44.6 | 18.0 | 16.0 | 16.0 | 5.4 |
| 6 | 44.6 | 16.0 | 18.0 | 16.0 | 5.4 |
| 7 | 45.6 | 16.0 | 18.0 | 14.0 | 6.4 |

What is claimed is:

1. A phase stable aqueous cleaning concentrate which does not separate into two or more phases when stored for 28 days at 125° F., the concentrate consisting essentially of, by weight based on the total weight, about 54.05% water, about 2.05% of an inorganic acid selected from the group consisting of hydrochloric and phosphoric acid, about 11.9% of an organic acid having a pKa value of from 1 to 5, and about 32% of surfactants as a mixture of nonionic and anionic surfactants at a weight ratio of 0.5:1 to 2.1:1, the weight of said inorganic acids being on an anhydrous basis.

2. The cleaning concentrate of claim 1 containing the mixture of nonionic and anionic surfactants in a weight ratio of 0.89:1 to 1.3:1.

3. The cleaning concentrate of claim 1 containing a mixture of nonionic and anionic surfactants at a weight ratio of 1.0:1 to 1.1:1.

4. The cleaning composition of claim 1, 2 or 3 containing hydrochloric acid.

5. The cleaning composition of claim 1, 2 or 3 containing phosphoric acid.

6. The cleaning composition of claim 1, 2 or 3 containing hydorchloric and glycolic acids.

7. The cleaning composition of claim 1, 2 or 4 wherein the anionic surfactant is dodecylbenzene sulfonic acid.

8. The cleaning composition of claim 1, 2 or 3 wherein the nonionic surfactant is an alkylphenoxyl poly (alkyleneoxy) ethanol of from about 9 to 12 mols of ethylene oxide per molecule, or a polyethylene glycol ehter of a $C_{11}$-$C_{15}$ fatty alcohol having 7 to 12 mols of ethylene oxide per molecule.

9. The cleaning compositions of claims 1, 2 or 3 wherein the pKa value of the organic acid is from 2.5 to 4.

* * * * *